US005251514A

United States Patent [19]

Rhodarmer et al.

[11] Patent Number: 5,251,514

[45] Date of Patent: Oct. 12, 1993

[54] METHOD FOR FORMING MOWER BLADES

[75] Inventors: Charles R. Rhodarmer; George J. Reed, both of Orangeburg; David F. Fowler, Cameron, all of S.C.

[73] Assignee: White Consolidated Industries, Inc., Cleveland, Ohio

[21] Appl. No.: 970,285

[22] Filed: Nov. 2, 1992

[51] Int. Cl.[5] ..... B21K 11/00

[52] U.S. Cl. ..... 76/104.1; 76/115; 72/412

[58] Field of Search ..... 76/101.1, 104.1, 115, 76/82.1; 72/376, 412

[56] References Cited

U.S. PATENT DOCUMENTS

| | | |
|---|---|---|
| 513,834 | 1/1894 | Smith . |
| 552,665 | 1/1896 | Miller . |
| 2,497,400 | 7/1946 | Eller . |
| 2,705,448 | 7/1951 | Ingersoll . |
| 2,705,534 | 4/1955 | Ingersoll . |
| 2,952,895 | 9/1960 | Ingersoll . |
| 3,050,830 | 8/1962 | Genter . |
| 3,096,608 | 7/1963 | Williamson . |
| 3,213,514 | 10/1965 | Evans . |
| 3,712,037 | 1/1973 | Knipe . |
| 4,198,803 | 4/1980 | Quick et al. . |
| 4,628,672 | 12/1986 | Jones . |
| 5,077,961 | 1/1992 | Schumacher, II et al. . |

FOREIGN PATENT DOCUMENTS

| | | |
|---|---|---|
| 2126944 | 11/1972 | Fed. Rep. of Germany . |
| 1411084 | 7/1988 | U.S.S.R. . |
| 2155294 | 9/1985 | United Kingdom . |

*Primary Examiner*—Roscoe V. Parker

*Attorney, Agent, or Firm*—Pearne, Gordon, McCoy & Granger

[57] ABSTRACT

The cutting edge on a lawn mower blade is formed by coining the edge of the blade. The blade is squeezed between a punch and die to produce the beveled edge and an extruded excess. The excess is sheared from the blade, leaving the beveled portion as the cutting edge.

2 Claims, 2 Drawing Sheets

METHOD FOR FORMING MOWER BLADES

BACKGROUND OF THE INVENTION

The invention relates to a method for making lawn mower blades and, in particular, for forming the cutting edge thereon.

A significant portion of the cost of manufacturing lawn mower blades has heretofore been spent on providing the necessary cutting edges on the blade.

The cutting edges have been produced by milling, grinding, or broaching.

Variations of these methods have also been used.

U.S. Pat. No. 5,077,961 shows a method for forming a cutting edge on a mower blade by first embossing a beveled edge on the blade. In the process, a portion of the blade is extruded 14 beyond this bevel. The extruded portion is then ground off.

Similarly, U.S. Pat. No. 4,198,803 coins a beveled edge on a harvesting machine's knife and then grinds off the portion extending out of the knife's plane.

The cutting edges of both of these patents still require that an expensive grinding process be used to produce the finished edge.

SUMMARY OF THE INVENTION

The present invention avoids the expensive step of grinding, milling or broaching a mower blade to produce a finished cutting edge.

The method of the invention forms a cutting edge on a strip-like lawn mower blade having an elongate edge. The method includes positioning the blade on a die. A coining punch is then forced against the blade near the elongate edge.

The punch forces a portion of the blade to be squeezed plasticly between the punch and die resulting in the blade having a beveled portion and a squeezed outwardly portion.

The squeezed outwardly portion is sheared from said blade leaving the beveled portion as the cutting edge.

In the preferred embodiment, the punch contacts the blade with a surface inclined with respect to the blade. This surface forms the beveled portion.

DESCRIPTION OF THE PREFERRED EMBODIMENT

Figure 1:
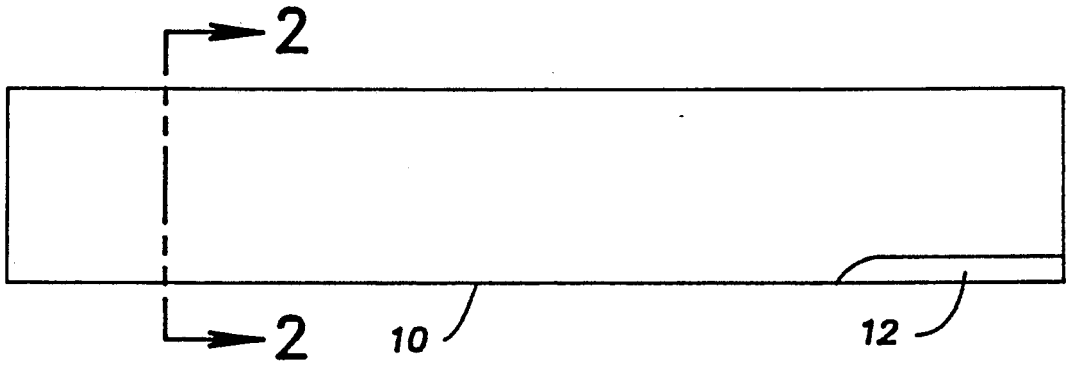
FIG. 1 is plan view of an exemplary lawn mower blade with one end already having a cutting edge formed according to the invention and the other end shown prior to forming the cutting edge of the invention.

Referring to FIG. 1, a strip-like blank for a blade 10 is shown with a beveled cutting edge 12 illustratively formed on one end. In practice, cutting edges at both ends of the blade 10 would be formed at the same time. The material of the blade 10 may be, for example, annealed medium carbon steel (e.g., 10B38). The thickness of the strip may be, for example, 0.118–0.151 inches.

Figure 2:
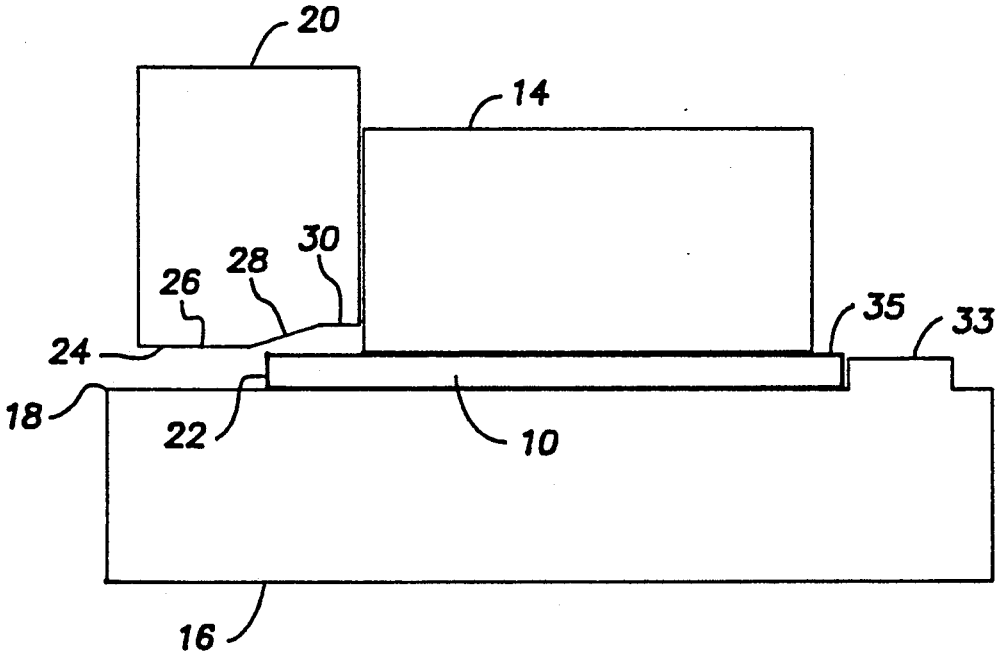
FIG. 2 is an enlarged cross sectional view of the blade of FIG. 1 through the line 2—2 with a die and coining punch according to the invention disposed thereabout.

Referring to FIG. 2, the blade 10 is clamped in position between a pressure plate 14 and a die 16. The die 16 has an upper surface 18 parallel to the plane of the blade 10.

A coining punch 20 is positioned above the blade 10 near its edge 22. The coining punch 20 has a lower surface 24. The surface 24 has a portion 26 parallel to the blade 10, an inclined portion 28 and another portion 30 parallel to the blade 10 but at a higher level than the portion 26.

An unshown actuator can move the punch 20 downward towards the die 16.

A rail 33 in the die 16 abuts the edge 35 of the blade 10.

Figure 3:
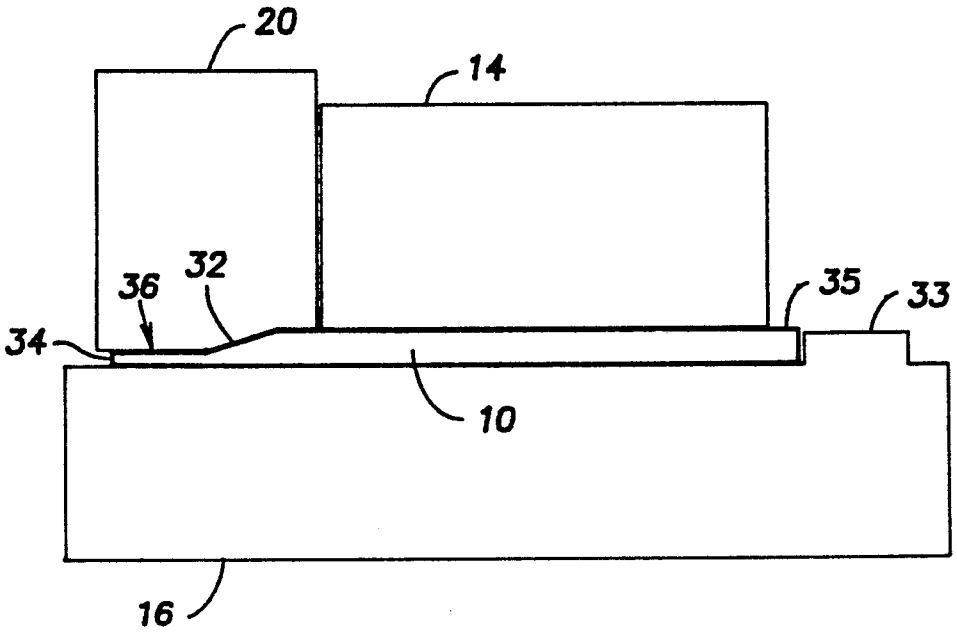
FIG. 3 is a cross sectional view of the blade of FIG. 2 after being deformed by the action of the die and punch.

Referring to FIG. 3, the punch 20 is shown at the limit of its downward travel.

When the punch 20 is forced to its downward limit, the blade 10 is deformed. A beveled portion 32 is formed on the blade 10 as the punch 20 lowers. The material of the blade 10 is squeezed between the punch 20 and the die 16. The pressure causes the edge material of the blade 10 to plasticly deform. During this process, an excess portion 34 of the blade 10 is extruded outwardly from its original limits.

The rail 33 prevents the blade 10 from moving in the direction of the rail 33 during the operation of the punch 20.

At its thinnest point 36, the beveled portion 32 may be, for example, 0.005–0.030 inches thick. The beveled portion 32 may be, for example, at a nominal angle of 25–30° with respect to the plane of the blade 10.

Figure 4:
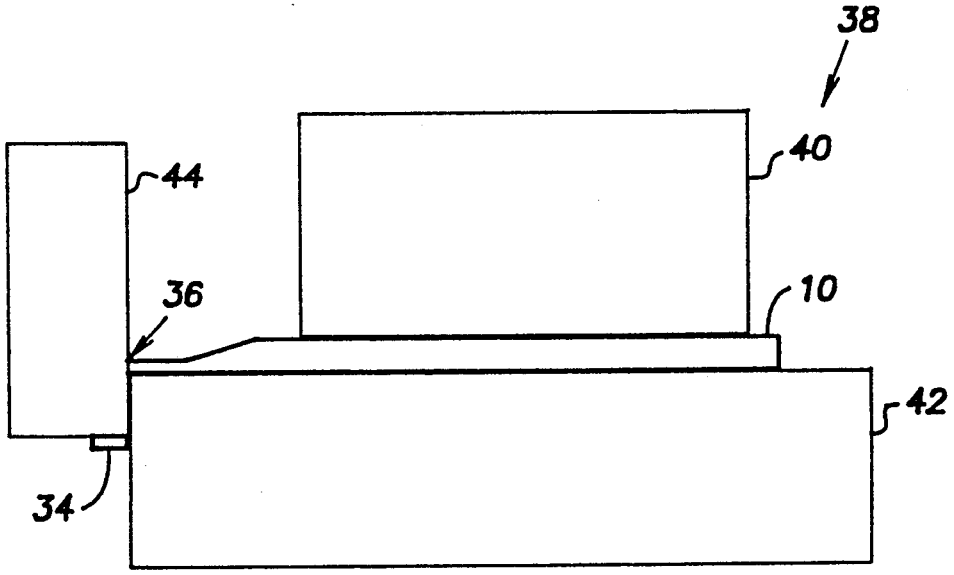
FIG. 4 is a cross sectional view of the blade of FIG. 3 after trimming by the shear disposed thereabout.

Referring to FIG. 4, the blade 10 has been moved to a trimming station 38. The blade 10 is clamped in position between a pressure plate 40 and a shearing plate 42. After the blade 10 is in position, a shearing bar 44 moves downward towards the blade 10. The bar 44 moves through the thinnest point 36, cutting the excess portion 34 from the blade 10 leaving a diametrically opposed image of the beveled cutting edge 12 shown in FIG. 1.

After trimming, the blade 10 has a cutting edge composed of the beveled portion 32 with a leading edge having a thickness of that of the thinnest point 36.

In practice, necessary holes can be punched in the blade 10 at the same time the excess portion 34 is trimmed. After the blade 10 is formed into a desired aerodynamic configuration, it is heat-treated to the desired hardness.

It has been advantageously found that a grass cutting blade need not have a "sharp" cutting edge; a leading edge as described above will give excellent cutting performance.

In addition, the coining process makes the beveled portion 32 harder then if it was ground, milled or broached, thus it keeps its edge longer. Also, the coining produces a smoother surface for better aerodynamics.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

WHAT IS CLAIMED

1. A method for forming a cutting edge on a strip-like lawn mower blade having an elongate edge, comprising:

positioning said blade on a die;

forcing a coining punch against said blade near said elongate edge, said punch forcing a portion of said blade to be squeezed plasticly between said punch and die resulting in said blade having a beveled portion and a squeezed outwardly portion; and shearing said squeezed outwardly portion from said blade leaving said beveled portion as said cutting edge.

2. A method according to claim 1, wherein said punch has a surface inclined with respect to said blade and said die has a surface parallel to said blade, said punch surface forming said beveled portion in cooperation with said die surface.

* * * * *